US009272801B2

(12) United States Patent
Murray

(10) Patent No.: US 9,272,801 B2
(45) Date of Patent: Mar. 1, 2016

(54) METHOD AND MACHINE FOR FILLING A FLEXIBLE POUCH HAVING A FITMENT

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 897 days.

(21) Appl. No.: 13/515,271

(22) PCT Filed: Dec. 10, 2010

(86) PCT No.: PCT/US2010/059819

§ 371 (c)(1),
(2), (4) Date: Jun. 11, 2012

(87) PCT Pub. No.: WO2011/072194

PCT Pub. Date: Jun. 16, 2011

(65) Prior Publication Data

US 2012/0317936 A1 Dec. 20, 2012

Related U.S. Application Data

(60) Provisional application No. 61/285,396, filed on Dec. 10, 2009.

(51) Int. Cl.

| | |
|---|---|
| ***B65B 1/04*** | (2006.01) |
| ***B65B 43/46*** | (2006.01) |
| ***B65B 3/04*** | (2006.01) |
| ***B65B 7/28*** | (2006.01) |
| ***B65B 43/54*** | (2006.01) |

(52) U.S. Cl.

CPC ..... *B65B 43/465* (2013.01); *B65B 3/045* (2013.01); *B65B 7/2821* (2013.01); *B65B 43/54* (2013.01)

(58) Field of Classification Search

CPC .... B65B 3/045; B65B 7/2821; B65B 43/465; B65B 43/54

USPC ..... 141/68, 314, 315, 346, 368, 369, 367, 141/370, 379

See application file for complete search history.

(56) References Cited

U.S. PATENT DOCUMENTS

| | | | | |
|---|---|---|---|---|
| 4,283,901 | A | 8/1981 | Schieser et al. | |
| 4,363,338 | A * | 12/1982 | Brown | 141/2 |
| 6,199,601 | B1 | 3/2001 | Laudenberg | |
| 7,380,575 | B2 * | 6/2008 | Stricklin | 141/166 |
| 2005/0199313 | A1 * | 9/2005 | Edwards et al. | 141/114 |
| 2005/0205158 | A1 | 9/2005 | Lacroix | |
| 2010/0038386 | A1 | 2/2010 | Pritchard | |

* cited by examiner

*Primary Examiner* — Jason K Niesz

(74) *Attorney, Agent, or Firm* — Dinsmore & Shohl LLP

(57) ABSTRACT

A machine for filling a flexible pouch having a fitment assembly, a gripper and a filler. The fitment assembly having a tap and a fitment mounted to the pouch body. The gripper operable to remove the tap from the fitment, retain the tap during filling operations, and mount the tap back onto the fitment after filling operations. The fitment assembly having a tap operable to be mounted on the fitment in a transport position and a fixed position, wherein in the transport position a first predetermined amount of force is required to remove the tap. In the fixed position, a second predetermined amount of force is required to remove the tap. The second predetermined amount of force is substantially larger than the first predetermined amount of force.

21 Claims, 13 Drawing Sheets

METHOD AND MACHINE FOR FILLING A FLEXIBLE POUCH HAVING A FITMENT

CROSS-REFERENCE TO RELATED APPLICATIONS

This application is a National Phase Application of PCT/US2010/059819, filed Dec. 10, 2010, which claims the benefit of U.S. Provisional Application 61/285,396 filed on Dec. 10, 2009, which are incorporated herein by reference in their entirety.

FIELD OF THE INVENTION

The invention relates to a machine for filling flexible pouches having a fitment assembly including a tap and a fitment, a gripper operable to remove the tap, retain the tap during filling operations, and mount the tap onto the fitment upon completion of filling operations.

BACKGROUND OF THE INVENTION

Flexible pouches are currently known and used in the art and include a fitment. The fitment includes a passageway for accessing the contents of the pouch. Some fitments also include a tap. Some taps include a lever and a valve operable to open and close access to the fitment. Other taps are configured for a push-pull arrangement wherein the tap is pulled away from the fitment to open access to the pouch or pushed against the fitment to close the access. Such pouches are often manufactured in one location and transported to another location for filling purposes.

It is common for the fitment to be formed onto the pouches, and the taps delivered to the filling warehouse separately from the pouch. In such arrangements the fitment is closed with a cover to prevent the interior of the pouch from being contaminated during transportation and filling operations. It is known to use a seal such as a polymeric wrap to cover the fitment opening to maintain the integrity of the interior of the pouch prior to filling operations.

The problem with such an arrangement is the increased transportation and the manufacturing costs associated with the pouches being shipped separately from the pouches, and the additional tooling required for removing the seal and mounting the taps. Further, some taps may be lost and thus new taps ordered to accommodate the fitments. Accordingly it remains desirable to have a method and machine for filling a flexible pouch with a fitment that reduces transportation and manufacturing costs by providing a seal to prevent the interior of the pouch from being contaminated and yet transporting the fitment and the tap as one unit.

SUMMARY OF THE INVENTION AND ADVANTAGES

A machine for filling flexible pouches having a tap mounted onto a fitment is provided. The tap includes a catch and the fitment includes a base. The machine is operable to fill the flexible pouches with a beverage. More specifically, the machine includes a gripper and a filler. The gripper is operable to remove the tap from the fitment, and retain the tap while the filler is engaged with the fitment during filling operations. Upon completion of filling operations, the filler is displaced from the fitment and the machine mounts the tap onto the fitment.

The gripper has a lip configured to retain the catch of the tap. In one instance, the gripper is operable to remove the tap from the fitment. In another instance, the gripper is operable to mount the tap onto the fitment. More specifically, the gripper is movable between an engaging position and a retaining position. In the engaging position the gripper is positioned so as to engage the tap. In the retaining position the gripper is displaced from the fitment and retains the tap.

The gripper further includes a housing adapted to fit the tap. The housing includes a pair of movable side walls each having a channel disposed above the lip. Each of the pair of side walls may further include a chamber adapted to accommodate the tap when the pair of side walls is in the closed position. The channel is adapted to receive an opposing portion of the catch of the fitment. The pair of side walls is movable between an open position and a closed position. In the open position each of the pair of side walls are displaced from each other so as to receive the tap. In the closed position each of the pair of side walls are displaced towards each other so as to engage the catch.

The machine further includes a filler having a first line in fluid communication with the beverage. The beverage may be housed in a first tank. The filler includes an opening for delivering the beverage into the flexible pouch. The filler is movable between a filling position and a ready position. Specifically, in the fill position the gripper is positioned so as to engage the fitment. In the ready position the gripper is displaced from the fitment.

In operation, the machine removes the tap from the fitment so as to expose the fitment for filling operations. Once the flexible pouch is filled, the tap may be mounted onto the fitment in the fixed position, wherein the tap is secured to the fitment so as to place the fitment assembly in a state acceptable for commercial sale and distribution.

A fitment assembly for use with a machine operable to fill the flexible pouches with a beverage is also provided. The fitment assembly includes a tap and a fitment. In one instance, the tap is positioned onto the fitment in a transport position. In another instance, the tap is positioned onto the fitment in a fixed position.

The tap includes an outer wall. The outer wall has an inner surface bounding an area so as to form a passage. The tap includes a tap opening on one end. The tap includes a tap edge extending inwardly from the inner surface. The tap may further include an inner wall disposed within the passage. The inner wall is spaced apart from the outer wall. The inner and outer walls cooperate so as to pinch a portion of the fitment there in between. The inner wall urges the tap edge into engagement with the outer surface of the fitment so as to help retain the tap in the transport and fixed positions.

The fitment includes a base and a neck extending from the base. The neck has an outer surface and a fitment opening. The outer surface of the neck is configured to be inserted within the tap opening. The neck further includes a first stop spaced apart from a second stop. The first and second stops are both disposed on the outer surface of the neck. The second stop extends outwardly from the outer surface of the neck so as to be further from the outer surface of the neck than the first stop. The first stop is closer to the fitment opening than the second stop. The first and second stops are operable to engage the edge of the tap so as to retain the tap in the transport position and the fixed position.

In operation, the fitment assembly is mounted onto the flexible pouch. The base may be sealed to the inner surface of the pouch body so as to place the neck on the exterior surface of the pouch body, thus the first and second stops are exposed. Prior to filling operations, the tap is mounted onto the neck so as to be positioned in the transport position. In the transport position the tap edge is disposed between the first and second stops. Thus, the tap may be relatively easily removed from the fitment, yet engaged sufficiently with the neck so as to maintain the transport position during transportation of the fitment assembly and processing of the flexible pouch.

The machine may further include a support. The support is movable between a first and a second position. In a first preferred embodiment, the support includes a stand and is pivotable between the first and second positions. The support includes a pair of arms fixedly mounted to the stand. The gripper is mounted onto one of the pair of arms, and the filler is mounted onto the other of the pair of arms. The stand is generally upright and each of the pair of arms extends radially from the stand.

The stand may be manually or automatically pivoted between the first and second positions. In the first position, the gripper is aligned with the fitment. In the second position, the filler is aligned with the fitment. In the first position the gripper is operable to either remove the tap from the transport position with respect to the fitment, or mount the tap onto the fitment so as to place the tap into the fixed position. In the second position, the filler is mounted onto the fitment so as to place the outer surface of the fitment within the opening of the filler. The beverage is introduced into the flexible pouch.

Upon completion of filling operations, the stand is pivoted to the first position, wherein the gripper mounts the tap onto the fitment. Specifically, the fitment is placed into the fixed position, wherein the flexible pouch may be ready for commercial sale. The flexible pouch may be removed from the machine, and an unfilled pouch fed to the machine wherein the machine repeats the steps above.

The machine may further include a keep. In the first preferred embodiment, the keep is disposed beneath the gripper and filler. The keep includes a slot configured to receive a portion of the fitment. The slot has a back edge, a side edge, and a pair of angled inner edges disposed between the back edge and the opening of the slot. The angled inner edges are spaced apart from each other to form a ramp shape. The angled inner edge is operable to guide the fitment into the abutment with the back edge and side edges of the slot. The keep is operable to retain the fitment in a fixed position for tap removal, tap mounting and pouch filling operations.

The machine may further include a pouch support disposed beneath the filler. The pouch support is a generally planar member having a pouch support surface. The pouch support surface faces the opening of the filler and is operable to hold the pouch body during filling operations. The pouch support is displaceable between an unloaded position and a loaded position so as to help provide support for the added weight of the beverage. The pouch support may further include a biasing member operable to urge the pouch support to the unloaded position.

In operation, the flexible pouch is fed into the keep so as to place the neck of the fitment into abutment with the back edge of the slot. The bottom surface of the flexible pouch rests on the pouch support surface of the pouch support. The fitment is retained by the keep as the gripper removes the tap from the fitment. The support is moved to the second position, wherein the filler is mounted onto the outer surface of the fitment. The pouch support moves from the unloaded to the loaded position as the added weight of the beverage is introduced into the flexible pouch.

Once filling is completed, the support is moved back to the first position, and the gripper mounts the tap onto the fitment so as to place the tap in the fixed position wherein the tap edge is displaced past both the first and second stops. The filled flexible pouch is removed from the pouch support. The biasing member of the pouch support urges the pouch support to the unloaded position wherein the pouch support is ready to receive an unfilled flexible pouch.

In a second preferred embodiment, the support moves axially between the first and second positions. In the first position the gripper is positioned to engage the tap, and the filler is positioned to fill the flexible pouch. In the second position, the gripper is positioned to remove and mount the tap onto the fitment. The gripper and filler are mounted to the support, wherein the gripper is located upstream the filler. The machine may include a first conveyor for transporting flexible pouches to the gripper, and a second conveyer downstream the first conveyor for transporting the filled flexible pouch.

The keep is disposed above the first conveyor and helps align the fitment for tap removal operations. The keep includes a first elongated member spaced apart the second elongated member so as to form a slot. A portion of the slot is aligned with the gripper. The slot is configured to receive the fitment. The flexible pouch is positioned under the first and second elongated members, and the fitment is disposed between the first and second elongated members. Thus, the keep guides the flexible pouch along the first conveyor.

The machine further includes a clamp disposed downstream the keep. The clamp is movable between an unclamped position and clamped position. The clamp includes a first clamp member spaced apart and opposite a second clamp member. In the unclamped position, the first and second clamp members are displaced away from each other so as to accommodate the fitment. In the clamped position the first and second clamp members are displaced towards each other. The first and second clamp members include a clamp edge. The clamp edge is configured to engage the neck of the fitment. In the clamped position, the clamp edge of the first and second clamp members are engaged with the neck of the fitment so as to hold the fitment in a fixed position and steady the flexible pouch for filling and tap mounting and removing operations.

In operation, an unfilled flexible pouch having a tap mounted in the transport position is fed onto the first conveyor. The conveyor transports the flexible pouch to the keep, wherein the fitment is positioned between the first and second elongated members, and the pouch body is positioned underneath the keep.

The support is in the first position, wherein the gripper is above and aligned with the tap. The gripper moves down so as to enclose the tap between the pair of moveable side walls. The moveable side walls are actuated and moved to the closed position wherein the catch of the tap is retained within the channel of respective first and second moveable side walls. The support is then moved axially downstream the keep, wherein the pouch is moved downstream the first conveyor and placed between the first and second clamp members.

The first and second clamp members are moved to the clamped position so as to hold the fitment in a fixed position. The gripper is then moved up and away from the fitment, removing the tap and holding the tap within the housing. The support is moved upstream to the first position so as to position the filler in alignment with the fitment. The filler is then moved to the fill position, coming downwardly to engage the outer surface of the fitment and fill the flexible pouch.

The second conveyor is disposed below the first conveyor so as to accommodate the expansion of the pouch during filling operations. Upon completion of the filling operation, the filler is disengaged from the fitment and the support is moved downstream so as to align the gripper with the fitment. The gripper mounts the tap onto the fitment and the moveable sidewalls are placed in the open position. The gripper moves up along an axis and the support moves upstream so as to place the gripper in alignment with the next tap.

The machine may be further operable to perform flushing operations wherein oxygen in is replaced with an inert gas. The filler includes a second line in fluid communication with a second tank. The second tank contains an inert gas. The second line is also in fluid communication with the opening of the filler. Thus, after filling the flexible pouch with the beverage, the filler is operable to introduce an inert gas into the pouch. The inert gas flushes out any oxygen and other gases from the flexible pouch. Thus the pouch contains an inert gas which helps preserve the beverage.

DETAILED DESCRIPTION OF THE PREFERRED EMBODIMENTS OF THE INVENTION

Figure 1:
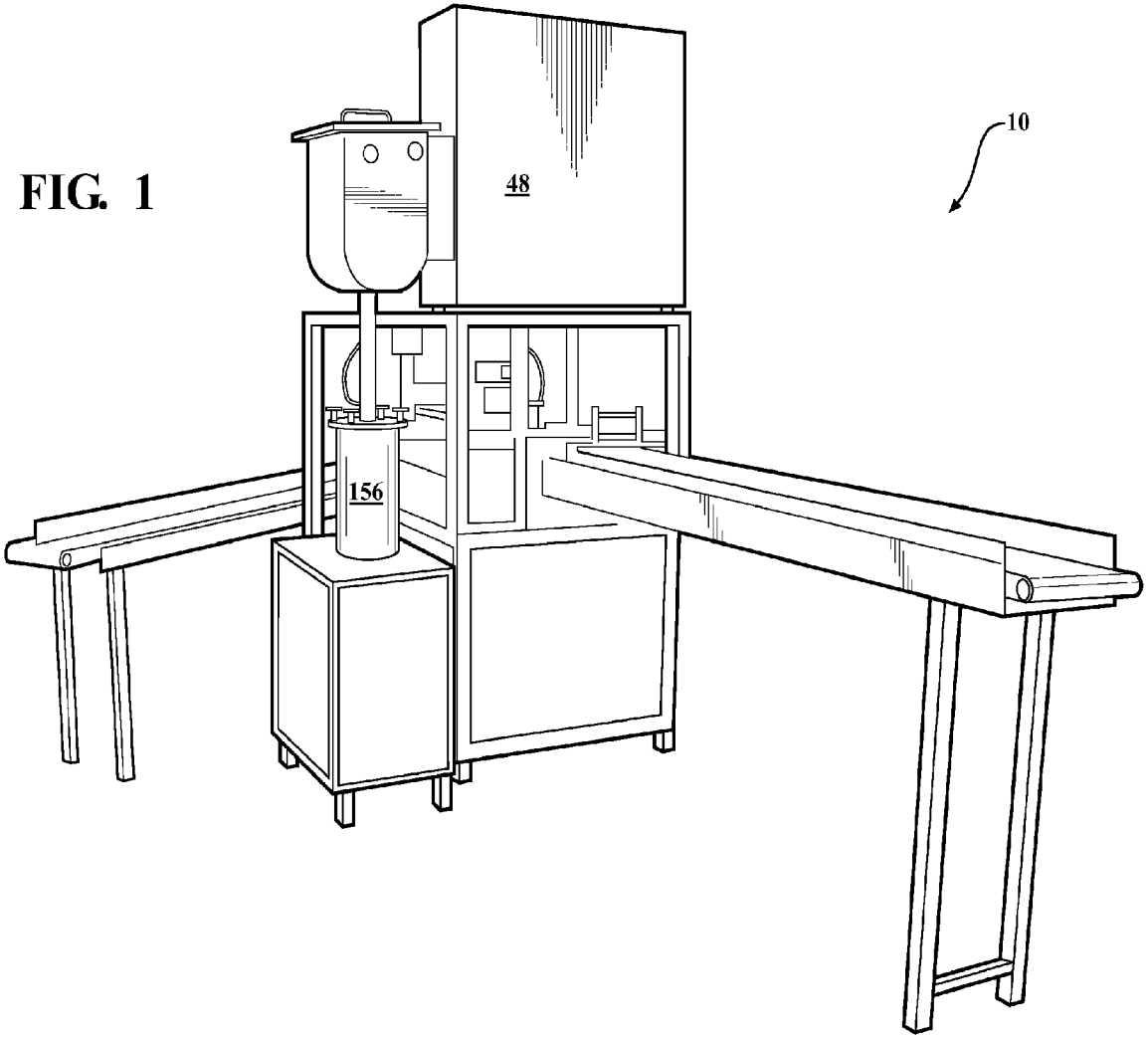
FIG. 1 is a perspective view a machine for filling flexible pouches.

With reference the figures, a machine 10 for filling flexible pouches 12 with a beverage 14 is illustrated. The machine 10 is configured to fill flexible pouches 12 having a tap 16 mounted onto a fitment 18. More specifically, the machine 10 is operable to remove the tap 16 from the fitment 18, and retain the tap 16 while the filler 20 is positioned onto the fitment 18 for filling operations. Upon completion of filling operations, the filler 20 is displaced from the fitment 18 and the machine 10 mounts the tap 16 onto the fitment 18. The tap 16 includes a catch 22 and the fitment 18 includes a base 24. The flexible pouch 12 is fed to the machine 10 with the tap 16 mounted onto the fitment 18. The catch 22 provides a surface for gripping and retaining the tap 16 during tap removal and mounting operations. In a preferred embodiment, the catch 22 is an annular flange disposed on the outer surface 26 of the tap 16.

Figure 2:
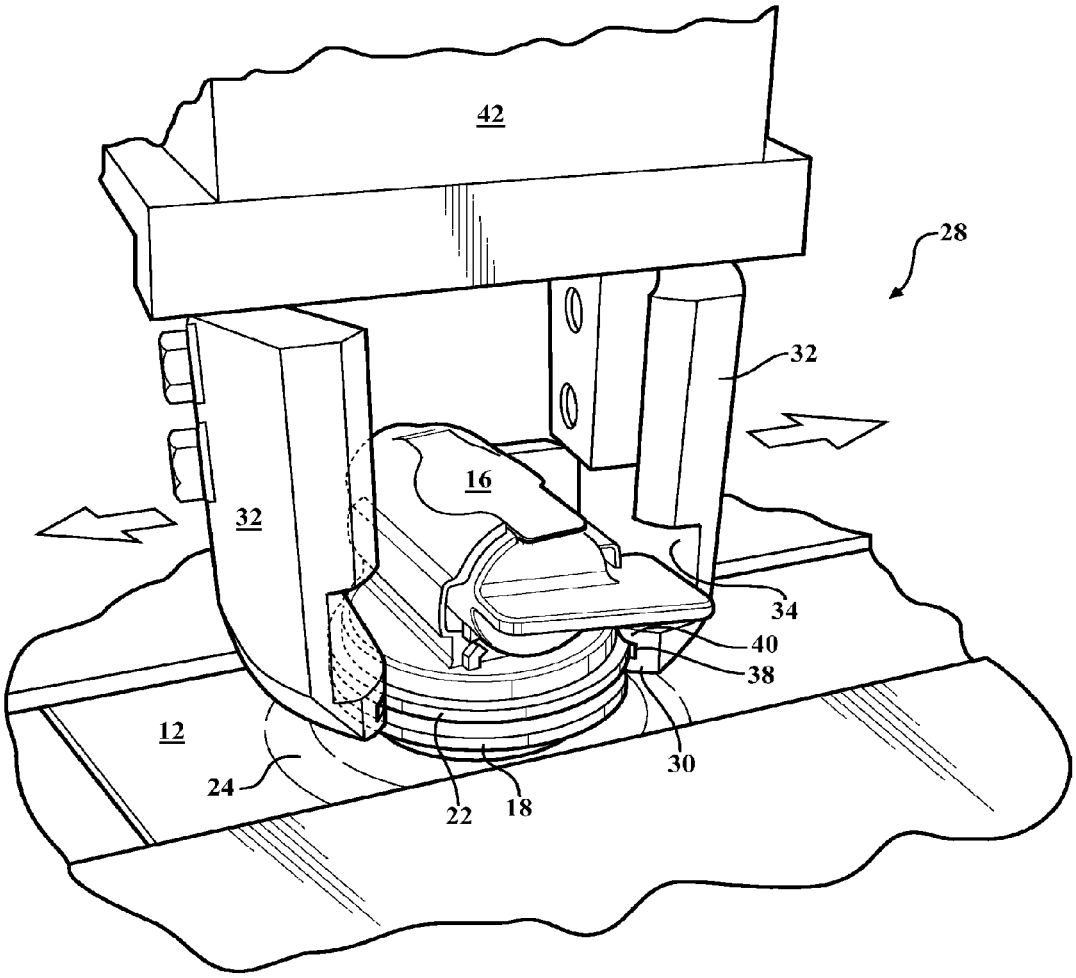
FIG. 2 is a perspective view of a gripper in the closed position.

With reference now to FIG. 2, a perspective view of a gripper 28 is provided. The gripper 28 has a lip 30 configured to retain the catch 22 of the tap 16. The gripper 28 is operable to remove the tap 16 from the fitment 18. The gripper 28 retains the cap and is further operable to mount the tap 16 back onto the fitment 18 after the flexible pouch 12 has been filled. Each of the pair of movable side walls 32 includes a chamber 34 adapted to accommodate the tap 16. The chamber 34 accommodates the tap 16 when the pair of movable side walls 32 in the closed position 36.

Each of the movable side walls 32 has a channel 38 formed along the inner wall surface of the movable side walls 32. The channel 38 is disposed above the lip 30 and beneath an upper lip 40. The channel 38 is formed near the distal end of the pair of movable side walls 32 opposite the first motor housing 42. The chamber 34 is formed by a cutout made along the inner wall surfaces of each of the pair of movable side walls 32 so as to accommodate tap 16 features such as a handle for actuating the tap 16 between an open and closed position.

Figure 3:
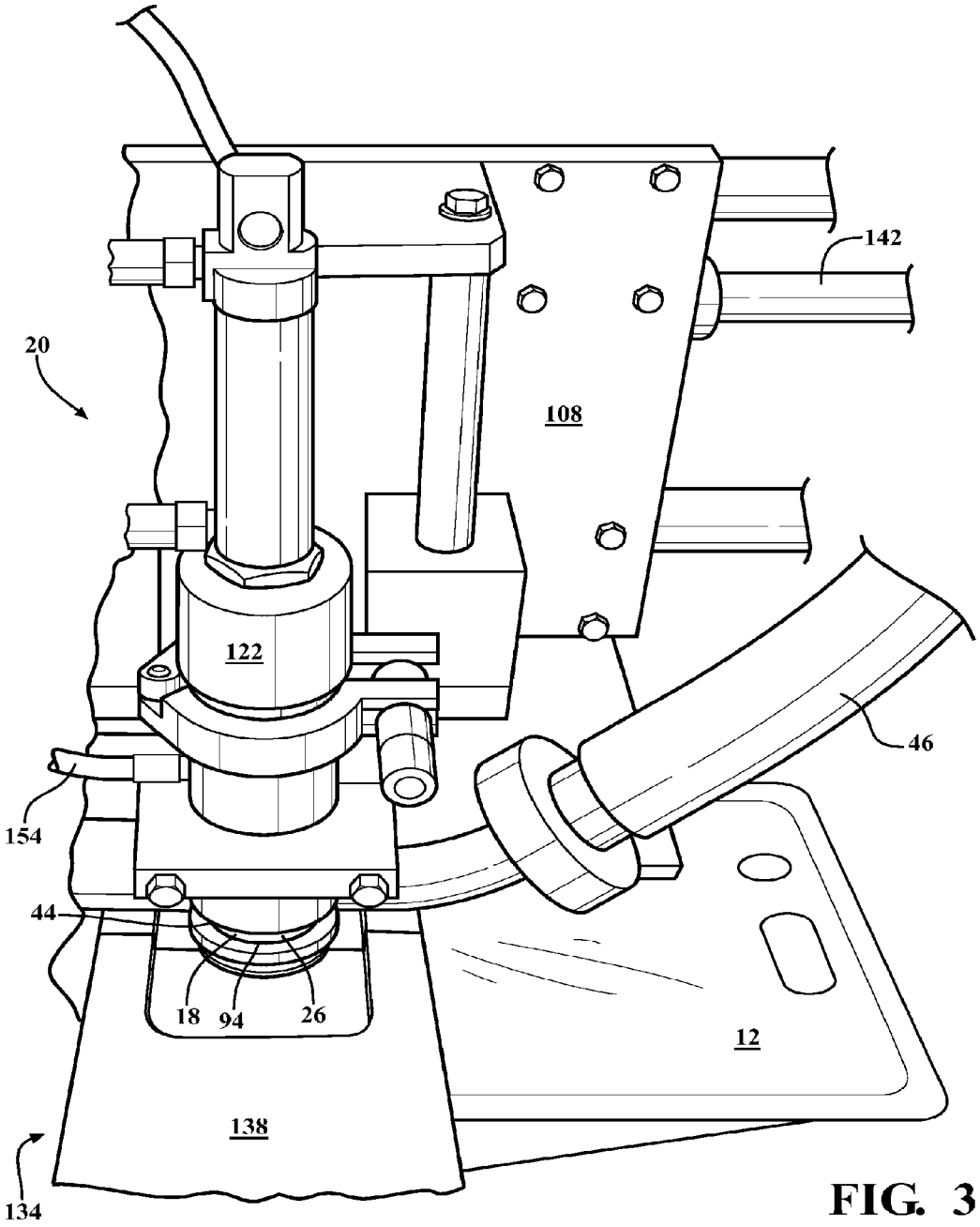
FIG. 3, is a perspective view of a filler mounted onto a fitment during filling operations.
Figure 8:
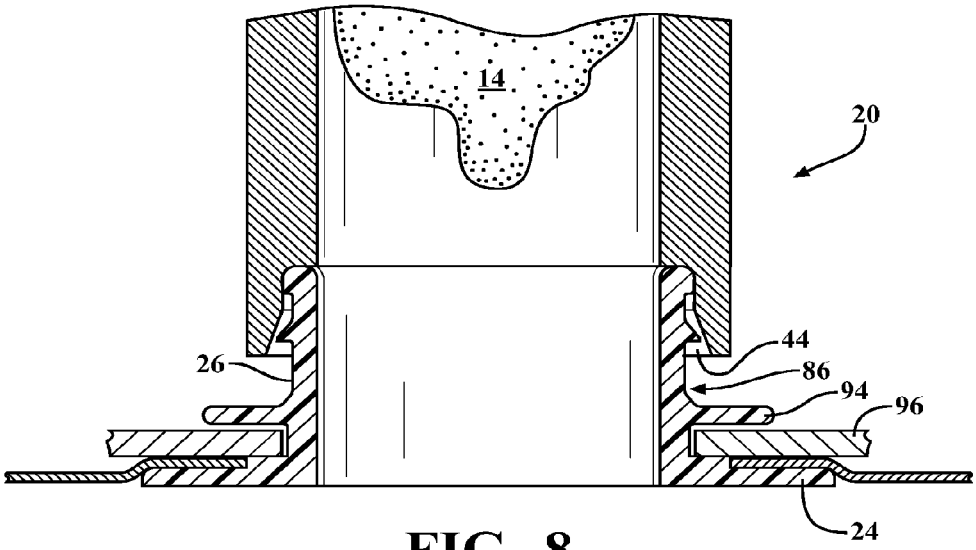
FIG. 8, is a perspective view of the filler engaged with the fitment, the outer surface of the fitment is mounted within the opening of the filler.

With reference now to FIG. 3, a perspective view of a filler 20 is provided. The filler 20 is operable to engage the fitment 18. The filler 20 has an opening 44 for delivering the beverage 14. The filler 20 further includes a first line 46 that is in fluid communication with the beverage 14. The beverage 14 may be housed in a first tank 48. The filler 20 is mounted onto the fitment 18 during filling operations. The opening 44 is configured to engage the outer surface 26 of the fitment 18, as shown in FIG. 8.

With reference now to FIGS. 4*a*-4*c*, and FIGS. 10*a*-10*g*, a perspective view of the operation of both the gripper 28 and filler 20 of the respective first and second preferred embodiments of the machine 10 is provided. The gripper 28 is operable to move between an engaging position 50 and a retaining position 52. In the engaging position 50 the gripper 28 is positioned so as to engage the tap 16 and the fitment 18. In the retaining position 52 the gripper 28 is displaced from the fitment 18 and holds the tap 16.

The filler 20 is movable between a fill position 54 and ready position 56. In the fill position 54 the filler 20 is positioned so as to engage the fitment 18. In the ready position 56 the filler 20 is displaced from the fitment 18. The machine 10 may be configured for manual feed of the flexible pouches 12 or for automated feed of the flexible pouches 12.

Figure 5:
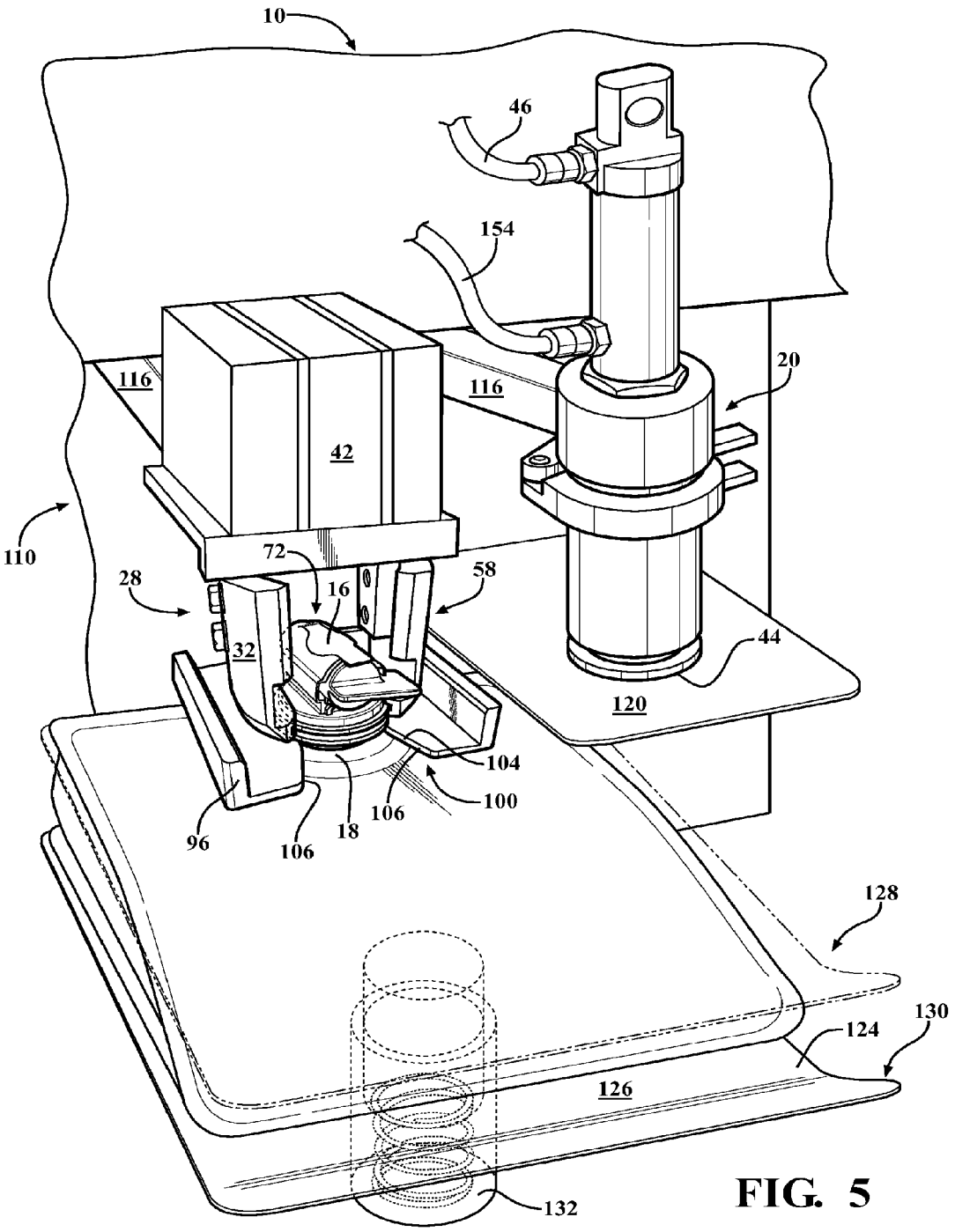
FIG. 5, is a perspective view of the first preferred embodiment of the machine, showing the pouch support and shield.

With reference again to FIG. 2 and now to FIG. 5, an illustrative view of the gripper 28 is provided. The gripper 28 includes a housing 58 adapted to accommodate the tap 16. The housing 58 includes a pair of movable side walls 32. Each of the pair of movable side walls 32 are spaced apart from each other. The housing 58 and the moveable side walls 32, 60, 62 may be formed of a rigid and durable material such as steel or a steel composite.

The pair of movable side walls 32 is movable between an open position 64 and a closed position 36 wherein in the open position 64 each of the pair of movable side walls 32 are displaced from each other so as to receive the tap 16 as indicated by the arrows. Each of the pair of movable side walls 32 are displaced towards each other so as to engage the catch 22 of the tap 16 when the pair of movable side walls 32 are in the closed position 36.

Figure 6:
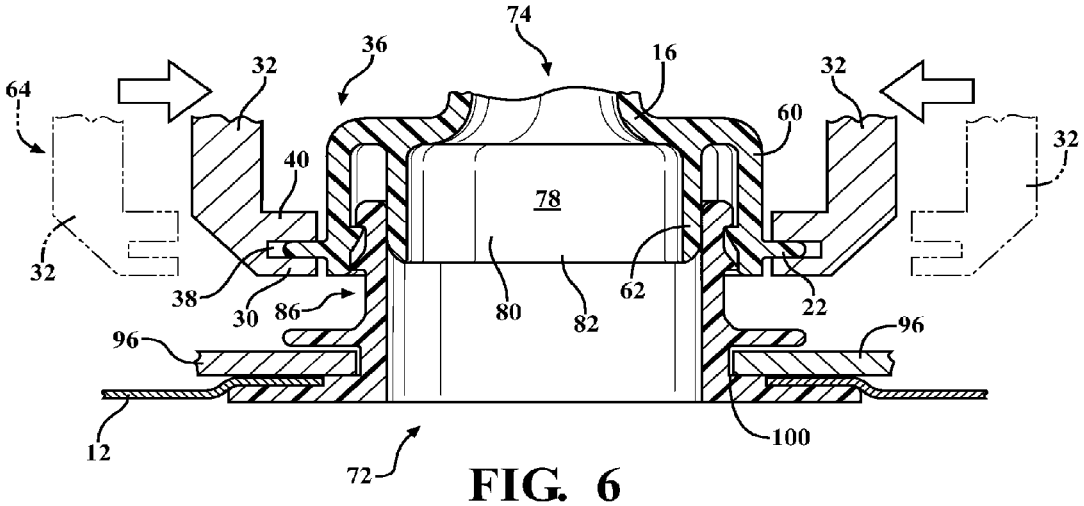
FIG. 6, is a perspective view of the gripper engaging the tap, wherein the tap is in the transport position.
Figure 7:
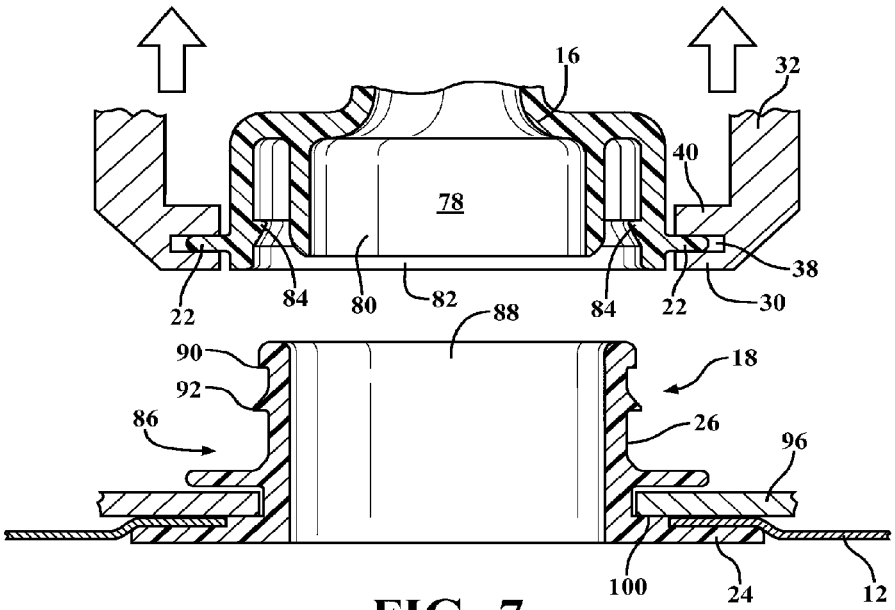
FIG. 7, is a perspective view of the gripper removing the tap from the fitment.
Figure 9:
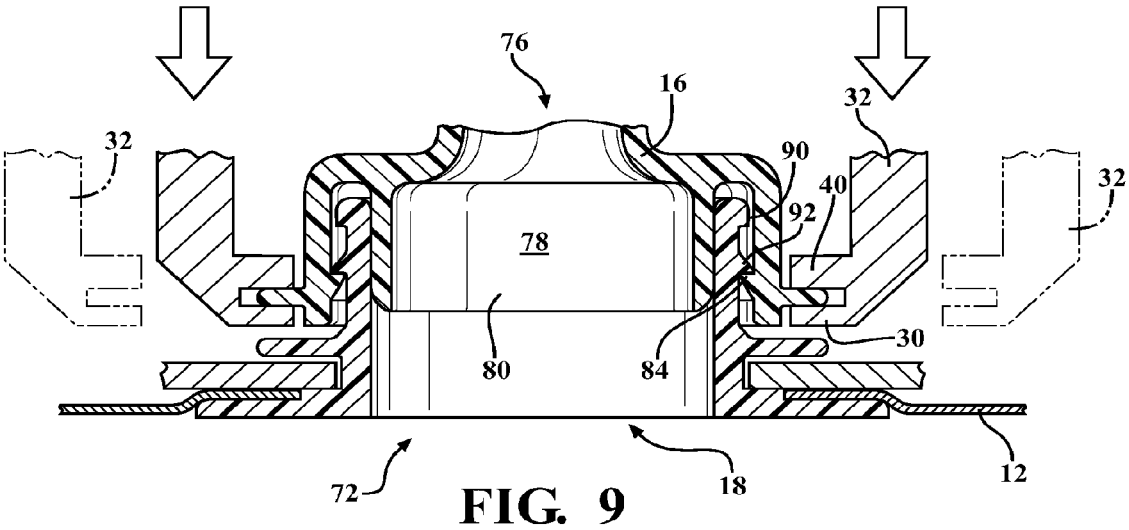
FIG. 9, is a perspective view of the gripper mounting the tap onto the fixed position, wherein the tap edge is pushed past the first and second stops.

With reference now to FIGS. 6, 7 and 9, a description of the operation of the gripper 28 is provided. With reference first to FIG. 6, the movable side walls 32 are displaced laterally from each other so as to create an opening adapted to receive the tap 16. The movable side walls 32 are shown in the open position 64 as indicated by the dashed figure. The movable side walls 32 may be displaced towards each other as indicated by the arrows so as to grip the catch 22.

The channel 38 is adapted to receive an opposing portion of the catch 22 of the tap 16. Respective opposing portions of the catch 22 are held between the lip 30 and the upper lip 40 of the tap 16. Thus, during tap 16 removal operations, the lip 30 is biased against an under surface of the catch 22 so as to pull the tap 16 from the fitment 18, as shown in FIG. 7. During tap mounting operations, the upper lip 40 presses against an upper surface of the catch 22 so as to urge the tap 16 onto the fitment 18, as shown in FIG. 9.

With reference now to FIGS. 7 and 9, the displacement of the gripper 28 along a vertical axis is provided. The gripper 28 may be actuated by a first drive 68 operable to drive the gripper 28 to engagement with the tap 16 and displacement from the tap 16. The gripper 28 may further include a first motor 70 operable to move the pair of movable side walls 32 between the open and closed positions 64, 36.

With reference again to FIGS. 6 and 7, a fitment assembly 72 is provided. The fitment assembly 72 includes a tap 16 and a fitment 18. The fitment assembly 72 may be formed from a resilient material such as plastic. The fitment assembly 72 is configured so as to facilitate the removal of the tap 16 for filling operations, yet enable the tap 16 to be permanently mounted onto the fitment 18 for commercial sale and use. In one instance, the tap 16 is position onto the fitment 18 in a transport position 74, as shown in FIG. 6. In another instance, the tap 16 is positioned onto the fitment 18 in a fixed position 76, as shown in FIG. 9.

The tap 16 has an outer wall 60. The outer wall 60 of the tap 16 includes an inner surface 78 bounding an area so as to form a passage 80. The tap 16 includes a tap opening 82 on one end of the passage 80. The tap 16 includes a tap edge 84 extending inwardly from the inner surface 78 of the outer wall 60. The tap 16 may further include an inner wall 62 disposed within the passage 80. The inner wall 62 is spaced apart the outer wall 60 and the tap edge 84.

The fitment 18 includes a base 24 and a neck 86 extending from the base 24. The base 24 is opposite the fitment opening 88. The base 24 has a planar surface extending radially from an end of the base 24. The neck 86 includes an outer surface 26 configured to be inserted within the tap opening 82. The neck 86 further includes a first stop 90 spaced apart a second stop 92. The first and second stops 90, 92 are disposed on the outer surface 26 of the neck 86. The second stop 92 extends outwardly from the neck 86 so as to be further from the outer surface 26 of the neck 86 than the first stop 90. The first stop 90 is closer to the fitment opening 88 than the second stop 92.

The first and second stops 90, 92 are operable to engage the tap edge 84 of the tap 16 so as to retain the tap 16 in either the transport position 74 or the fixed position 76. The inner and outer walls 62, 60 of the tap 16 cooperate to pinch the neck 86 when the tap 16 is mounted onto the fitment 18. The inner and outer walls 62, 60 help urge the tap edge 84 against the outer surface 26 of the neck 86 so as to help retain the tap 16 in either the transport position 74 or the fixed position 76.

With reference again to FIG. 6, a cross-sectional view of the tap 16 in the transport position 74 is provided. Removal of the tap 16 from the fitment 18 when in the transport position 74 requires a first predetermined amount of force. Transporting the tap 16 mounted on the fitment 18 reduces packaging space, shipment costs, missing parts, and provides a seal for the fitment opening 88 during transportation so as to prevent the pouch body from being contaminated. The first predetermined amount of force may be easily overcome so as to facilitate the removal of the tap 16 for filling operations. An example of an acceptable range for the first predetermined amount of force is between 5 to 20 lbs.

With reference again to FIG. 9, a cross-sectional view of the tap 16 in the transport position 74 is provided. Removal of the tap 16 from the fitment 18 when in the fixed position 76 requires a second predetermined amount of force. The second predetermined force is substantially larger than the first predetermined force such that the tap 16 is not easily dislodged when used by the consumer. Specifically, the second predetermined amount of force must be sufficient to retain the tap 16 onto the fitment 18 as the tap 16 is being actuated by a user. For instance, the tap 16 may be a push-pull tap 16, wherein the tap 16 is pulled away from the fitment 18. Alternatively, the tap 16 may include a lever, as shown in the drawings, which may be rotated so as to position a valve to open. An example of an acceptable range for the second predetermined amount of force is between 40 to 80 lbs.

The fitment 18 may include a second flange 94 disposed on the outer surface 26 of the neck 86. The second flange 94 is disposed between and spaced apart the base 24 and the second stop 92. The second flange 94 extends further away from the outer surface 26 of the neck 86 than the second stop 92.

With reference now to FIG. 5, the machine 10 may further include a keep 96. The keep 96 is operable to engage the neck 86 of the fitment 18 between the base 24 and the second flange 94. The keep 96 is disposed beneath the gripper 28. In a first preferred embodiment, the keep 96 includes a slot 98 having a slot edge 100 and a gripper 28 surface. The slot edge 100 includes a back edge 102, a side edge 104, and a pair of angled inner edges 106. Each of the pair of angled inner edges 106 is angled inwardly toward one another so as to define a pair of ramp-shaped features operable to help guide and key the fitment 18 into abutment with the back end of the slot 98. The slot edge 100 is operable to retain the fitment 18 in a fixed position 76 for tap removal, tap mounting, and pouch filling operations. The keep 96 may be formed of a durable material such as stainless steel or other steel composites.

With reference again to FIGS. 4A-4C, and 5, a perspective view of a machine 10 of the first preferred embodiment is provided. The machine 10 may further include a support 108. The gripper 28 and the filler 20 may both be mounted on the support 108. In a first preferred embodiment the support 108 pivots between a first position 110 and a second position 112. In the first position 110 the gripper 28 is positioned to engage the fitment 18, and the filler 20 is displaced off to the side of the fitment 18. In the second position 112 the filler 20 is positioned to engage the fitment 18, and the gripper 28 is displaced off to the side of the fitment 18.

The support 108 may include a stand 114 and a pair of arms 116 fixedly mounted to the stand 114. The gripper 28 is mounted to one of the pair of arms 116 and the filler 20 is mounted to the other of the pair of arms 116. The stand 114 is rotatable about an axis. The stand 114 is generally upright and each of the pair of arms 116 extends radially from the stand 114. Thus rotation of the stand 114 pivots the gripper 28 and filler 20 into alignment with the fitment 18 so as to facilitate tap removal, tap mounting, and filling operations.

The support 108 may include a support motor 118 operable to rotate the stand 114 between the first and second positions 110, 112. The machine 10 may further include a shield 120. The shield 120 is adjacent the keep 96 and is positioned beneath the opening 44 of the filler 20 when the support 108 is in the first position 110. The shield 120 includes a shield surface 120*a* facing the opening 44 of the filler 20. The shield surface 120*a* may be a generally planar surface and may be angled so as to direct drippings from the filler 20 away from the flexible pouch 12.

With reference now to FIGS. 4A-4C and 5 a description of the operation of the machine 10 of the first preferred embodiment is provided. In operation an unfilled flexible pouch 12 having a fitment 18 and a tap 16 mounted onto the fitment 18 is fed to the keep 96.

The base 24 of the fitment 18 is slid to the underside of the keep 96 so that the upper exposed portion of the fitment 18 is engaged with the slot edges 100. The pair of angled inner edges 106 helps guide the fitment 18 into proper engagement with slot 98. The fitment 18 is slid into abutment with the back edge 102 of the slot 98.

Figure 4C:
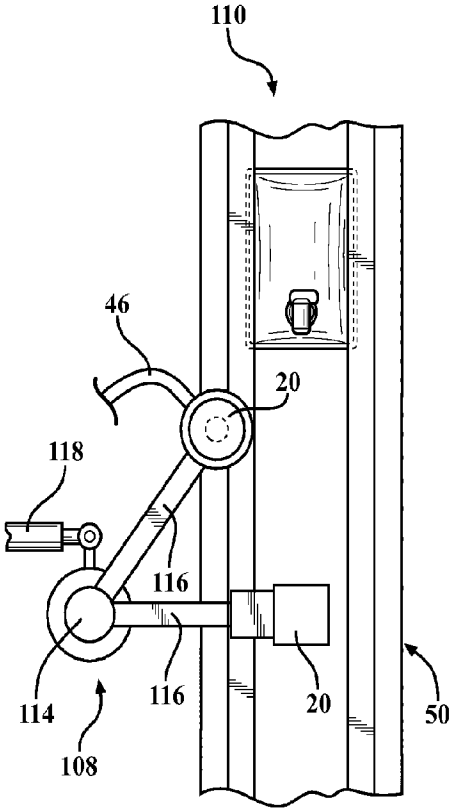
FIG. 4C, is a top view of a first preferred embodiment of the machine in the first position, wherein the tap is mounted onto the fitment.
Figure 4B:
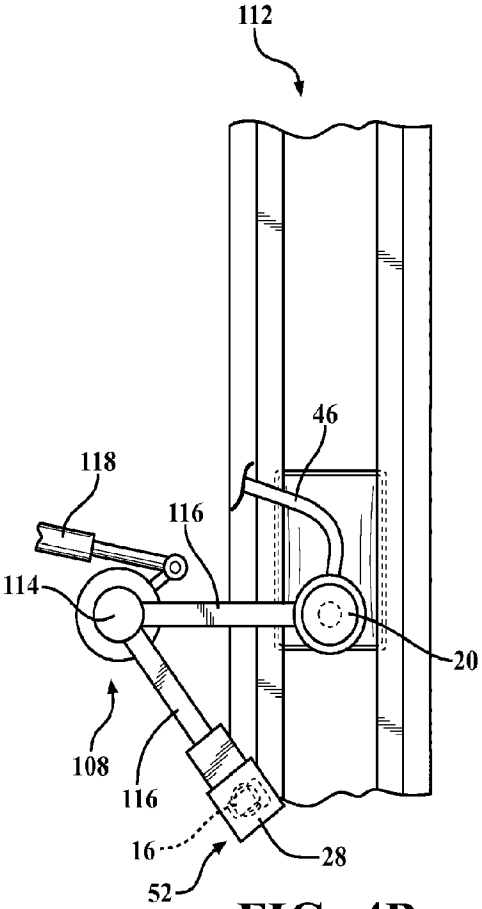
FIG. 4B, is a top view of a first preferred embodiment of the machine in the second position, wherein the gripper retains the tap while the flexible pouch is being filled.
Figure 4A:
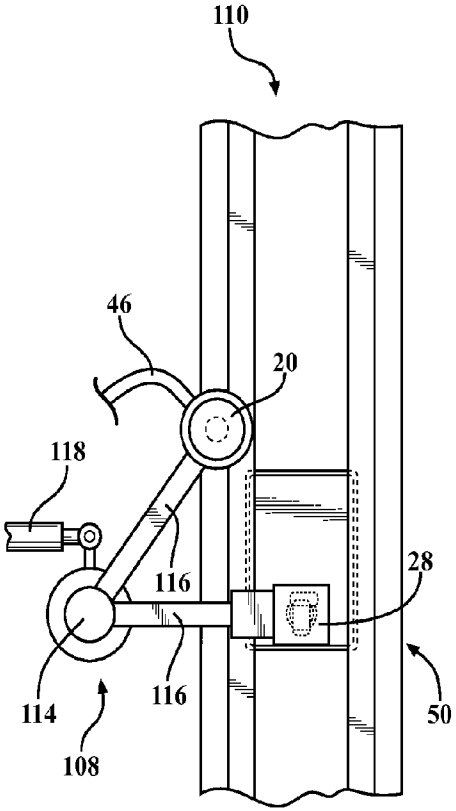
FIG. 4A, is a top view of a first preferred embodiment of the machine in the first position, wherein the tap is removed from the fitment.

With reference first to FIG. 4A, the stand 114 is positioned to the first position 110 wherein the gripper 28 is aligned with the tap 16. The first drive 68 is operable to move the gripper 28 up and down so as to pull the tap 16 from and mount the tap 16 onto the fitment 18. The first motor 70 may be actuated so as to place the pair of movable side walls 32 in the open position 64. As stated above, in the open position 64, each of the pair of movable side walls 32 are spaced apart and configured to receive the tap 16. The first drive 68 displaces the gripper 28 downwardly, so as to place the tap 16 between each of the pair of movable side walls 32, as shown in FIG. 6.

The first motor 70 is actuated and moves the pair of movable side walls 32 from the open position 64 to the closed position 36 wherein the lip 30 engages an undersurface of the catch 22 so as to seat the catch 22 within the channel 38 between the lip 30 and the upper lip 40. The handle of the tap 16 is held within the chamber 34 of the movable side walls 32. The first drive 68 is actuated and the gripper 28 is lifted up so as to pull the tap 16 away from the fitment 18, as shown in FIG. 7.

A support motor 118 may be mechanically coupled to the support 108 so as to rotate the stand 114 between the first and second positions 110, 112. The support motor 118 is actuated after the tap 16 has been removed from the fitment 18 so as to rotate the stand 114 to the second position 112, as shown in FIG. 4B. During this movement, the tap 16 is held between the side wall of gripper 28 and the filler 20 is pivoted to the second position 112.

In the second position 112, the filler 20 is axially aligned with the opening 44 of the fitment 18. The filler 20 may include a second drive 122 operable to drive the filler 20 between the ready position 56 and a fill position 54. In the ready position 56, the filler 20 is disengaged from the fitment 18. In the fill position 54, the filler 20 is engaged with the fitment 18.

As the filler 20 moves from the ready to the fill position 54, the filler 20 is displaced downwardly so as to engage the fitment 18 and deliver fluids into the pouch body, as shown in FIG. 8. Once the pouch is filled, the filler 20 is displaced upwardly so as to disengage the fitment 18. Throughout this process, the gripper 28 retains the fitment 18, as shown in FIG. 4B.

With reference now to FIG. 4C, the first motor 70 is then operable to rotate the stand 114 from the second position 112 to the first position 110 where the gripper 28 is again positioned in alignment with the fitment 18. During this time the filler 20 is disposed above the shield 120 wherein any drippings are caught by the shield 120 so as to prevent the machine 10 from being contaminated by beverages 14.

With reference now to FIG. 9, the first drive 68 is actuated so as to move the gripper 28 downwardly and mount the tap 16 onto the fitment 18. Once the tap 16 is mounted onto the fitment 18, the first motor 70 is operable to displace each of the pair of movable side walls 32 from the closed position 36 to the open position 64. The first drive 68 is then actuated so as to move the gripper 28 away from the fitment 18. The filled pouch is removed and the machine 10 is ready to fill the next flexible pouch 12.

With reference again to FIG. 5, a pouch support 124 is provided. The pouch support 124 may be disposed beneath the keep 96 so as to support 108 the flexible pouch 12 during filling operations. The pouch support 124 has a pouch support surface 126 operable to hold the pouch during filling operations. The pouch support 124 helps reduce the load applied to the fitment 18 during filling operations so as to further help maintain the flexible pouch 12 in a fixed position 76 thus providing stability and preventing damage to the flexible pouch 12 during filling operations.

The pouch support 124 is displaceable between an unloaded and a loaded position 128, 130. In the unloaded position 128 the pouch support 124 is adjacent the keep 96 and the flexible pouch 12 is fed in between the keep 96 and the pouch support 124. During filling operations the added weight of beverage 14 lowers the pouch support 124 from the unloaded to the loaded position 130.

The pouch support 124 may further include a biasing member 132 operable to urge the pouch support 124 to the unloaded position 128. Thus, as the weight of added beverages 14 is placed on the pouch support 124, the pouch support 124 is displaced from the unloaded to the loaded position 130. Upon completion of filling operations, the flexible pouch 12 may be removed from the keep 96 and pouch support 124, and the biasing member 132 urges the pouch support 124 to the unloaded position 128 wherein the machine 10 is ready for another flexible pouch 12 to be fed.

With reference now to FIGS. 10A-10G, 11, and 12, a second preferred embodiment of the machine 10 is provided. The support 108 moves axially between the first and second position 110, 112. The machine 10 includes a clamp 134 operable to move between a clamped and an unclamped position. The clamp 134 is disposed downstream the keep 96. In the clamped position, the clamp 134 is closed about the fitment 18 so as to retain the flexible pouch 12 for pouch filling and tap mounting operations. In the unclamped position the clamp 134 is open so as to receive the fitment 18.

The clamp 134 includes a first clamp member 136 and a second clamp member 138. In the clamped position the first and second clamp members 136, 138 are moved towards each other so as to close onto the fitment 18, holding the fitment 18 in place. The first and second clamp members 136, 138 may be mechanically coupled to a clamp motor 140 operable to move the first and second clamp members 136, 138 between the clamped and unclamped position.

The machine 10 may further include a rail 142 disposed above a first conveyor 144. The first conveyor 144 may include a belt 146 rotated about a conveyor drive 148. The rail 142 extends axially along a generally horizontal plane. The support 108 is mounted to the rail 142. The support motor 118 is operable to move the support 108 between a first and second position 110, 112 along the rail 142.

The keep 96 includes a pair of bars 150 spaced apart from each other disposed above the first conveyor 144, defining a slot 98 extending axially along the first conveyor 144 and displaced generally in the middle of the first conveyor 144. A portion of the slot 98 is aligned with the gripper 28. The keep 96 guides the flexible pouch 12 along a first conveyor 144.

The machine 10 may further include a second conveyor 152. The second conveyor 152 includes a belt 146 disposed beneath the upper surface of the first conveyor 144. The second conveyor 152 is disposed downstream the first conveyor 144 and aligned with the filler 20 when the support 108 is in the second position 112.

The filler 20 may further include a second line 154 in fluid communication with a second tank 156. The second tank 156 contains an inert gas. The filler 20 is movable between a ready position 56 and a fill position 54. In the fill position 54 the opening 44 of the filler 20 is mounted over the outer surface 26 of the fitment 18. In the ready position 56 the filler 20 is displaced from the fitment 18. The machine 10 may include a filler 20 motor operable to move the filler 20 between the ready and fill positions 56, 54.

With reference again to FIGS. 10A-10G, an operation of the machine 10 of the second preferred embodiment is provided. The first conveyor 144 is operable to feed the fitments 18 to the gripper 28. Specifically, the first conveyor 144 advances the flexible pouch 12 downstream to the keep 96, wherein the fitment 18 is slid along the slot 98 of the keep 96. The first conveyor 144 stops 90, 92, when the tap 16 is aligned with the gripper 28. The machine 10 may include a sensor 158 operable to detect the presence of the tap 16 so as to stop the first conveyor 144 when the fitment 18 is in alignment with the gripper 28.

Figure 10A:
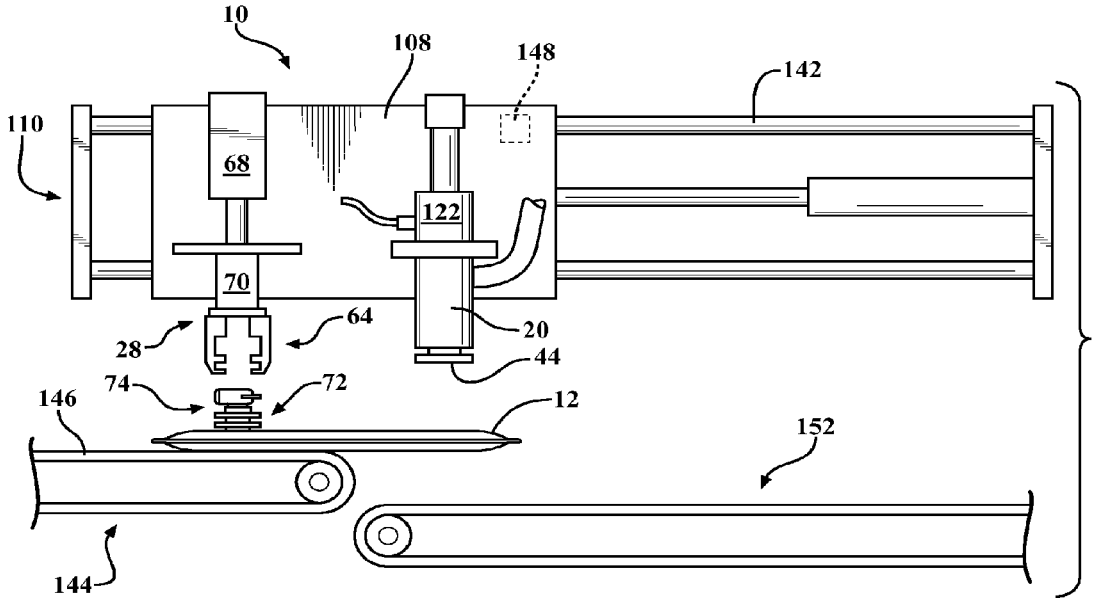
FIG. 10A, is a perspective view of the second preferred embodiment of the machine showing the support in the first position, wherein the gripper is aligned with the fitment and in the open position.
Figure 10B:
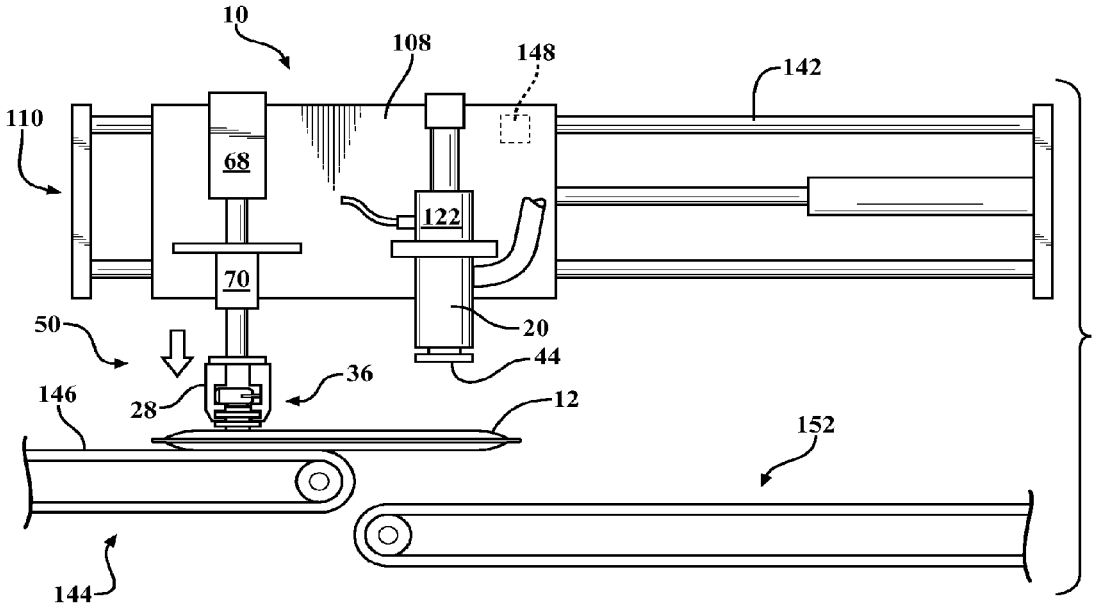
FIG. 10B, is a perspective view of the second preferred embodiment of the machine showing the support in the first position, wherein the gripper is in the engaged position and the movable sidewalls are in the closed position.
Figure 10C:
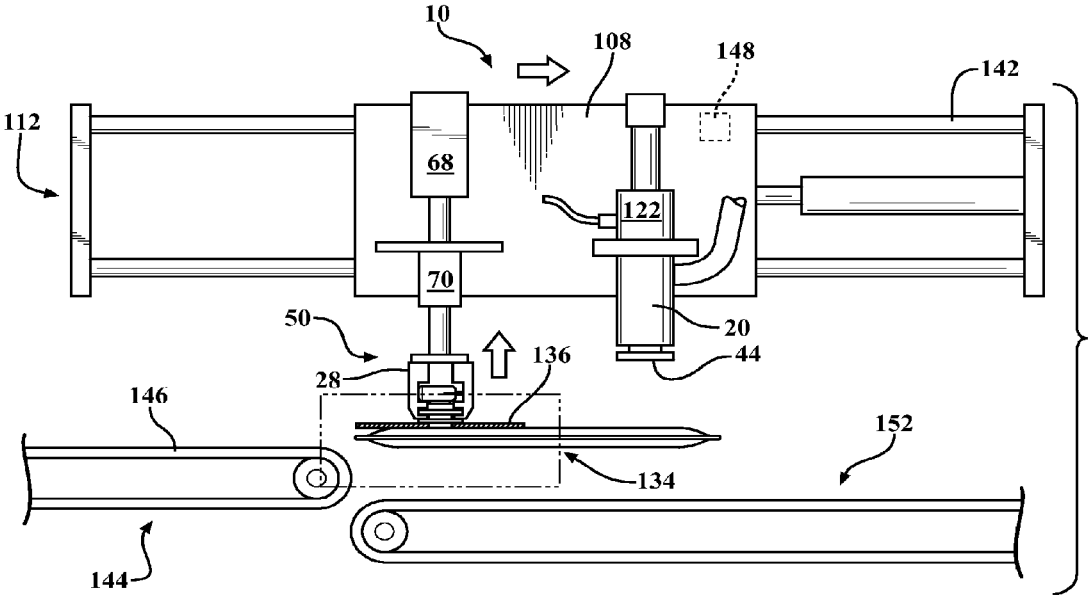
FIG. 10C, is a perspective view of the second preferred embodiment of the machine showing the support in the second position, the gripper slides the flexible pouch downstream the conveyor.

With reference first to FIG. 10A, the gripper 28 is positioned above the first conveyor 144, and the pair of movable side walls 32 is in the open position 64. The first drive 68 actuates the gripper 28 and moves the gripper 28 downwardly so as to position the tap 16 between each of the pair of the movable side walls 32, as shown in FIG. 10B. The first motor 70 is actuated so as to close the gripper 28. Wherein the tap 16 is retained within the housing 58. The support 108 then moves to axially downstream the conveyer to the second position 112, as shown in FIG. 10C. Wherein the flexible pouch 12 is slid downstream along the first conveyor 144 towards the clamp 134.

The clamp 134 is positioned in the unclamped position so as to receive the fitment 18 between the first and second clamp members 136, 138, as shown in FIG. 3. The clamp 134 is then moved to the clamped position wherein the first and second clamp members 136, 138 are displaced towards one another so as to engage the neck 86 of the fitment 18. More specifically, the clamp 134 engages the portion of the neck 86 between the base 24 and the second flange 94. A portion of the flexible pouch 12 is disposed above the first conveyor 144.

Figure 10D:
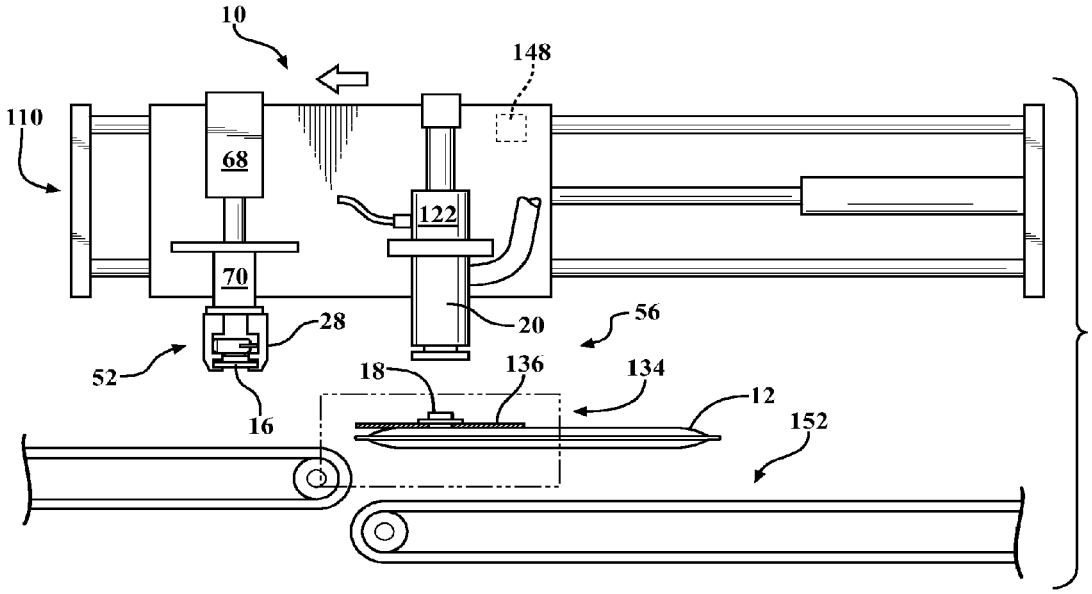
FIG. 10D, is a perspective view of the second preferred embodiment of the machine showing the support in the first position, wherein the filler is aligned with the fitment, and the tap is retained in the gripper.

Once the clamp 134 secures the fitment 18, the flexible pouch 12 is retained in a fixed position 76. The first drive 68 moves the gripper 28 upwardly so as to remove the tap 16 from the fitment 18. Specifically, the base 24 of the fitment 18 is retained by the keep 96 as the gripper 28 moves upwardly to lift the tap 16, thus the tap 16 is removed from the fitment 18 as indicated by the upwardly pointing arrow. The tap 16 is retained in the gripper 28, and the support 108 moves axially upstream to the first position 110, placing the filler 20 in alignment with the fitment 18, as shown in FIG. 10D.

Figure 10E:
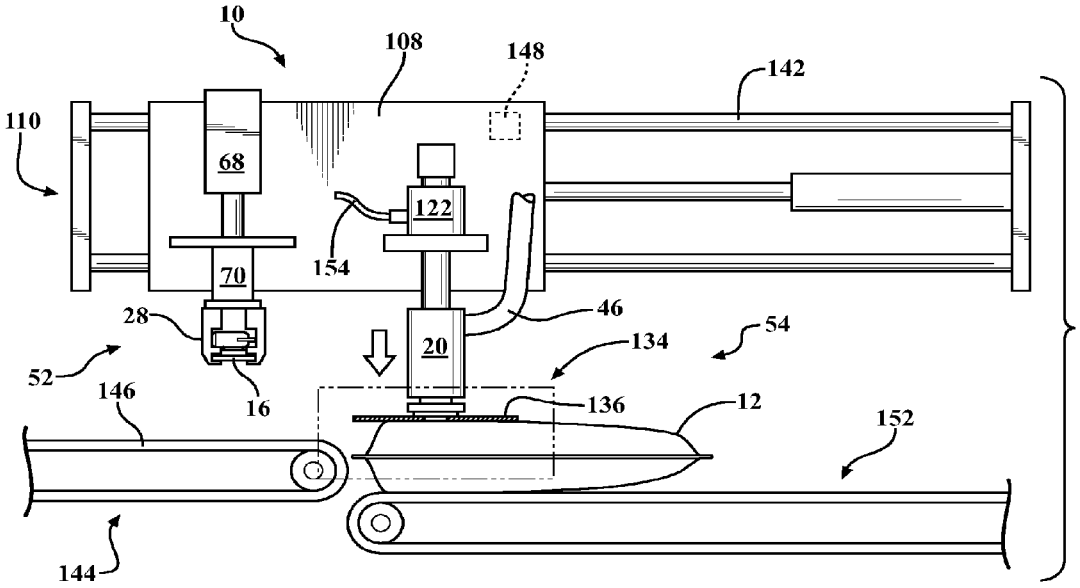
FIG. 10E, is a perspective view of the second preferred embodiment of the machine showing the support moved back to the first position, wherein the filler is engaged with the fitment.

With reference now to FIG. 10E, the second drive 122 displaces the fitment 18 downwardly into engagement with the fitment 18. In a preferred embodiment, the opening 44 of the filler 20 is slid onto the outer surface 26 of the fitment 18. A beverage 14 is introduced into the flexible pouch 12. As the flexible pouch 12 expands, the pouch abuts against the surface of the second conveyor 152. Thus the second conveyor 152 may be further operable to reduce the load on the fitment 18 during filling operations.

Once the flexible pouch 12 is filled, the filler 20 may be operable to introduce an inert gas into the flexible pouch 12 so as to displace oxygen from the pouch.

The oxygen may react with the beverage 14 which may shorten the life of the beverage 14. Accordingly, displacing the oxygen with an inert gas, also referenced in the art as flushing, helps preserve the quality of the beverage 14 for a longer period relative beverage 14 pouches having oxygen. Illustratively, the area of the flexible pouch 12 that is flushed out with the inert as may be referred to as the head.

Figure 10F:
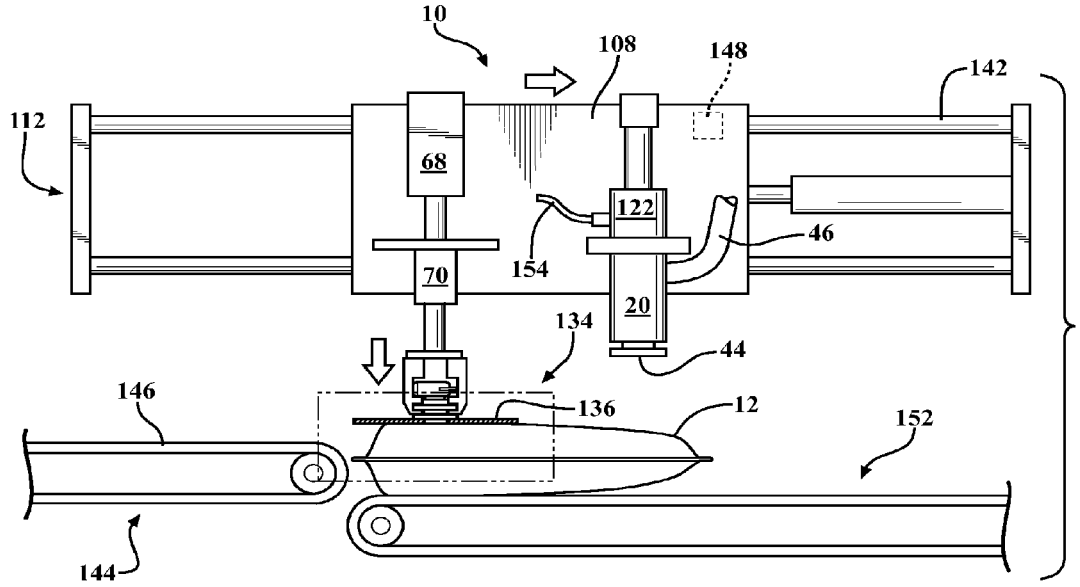
FIG. 10F, is a perspective view of the second preferred embodiment of the machine showing the support moved back to the second position, wherein the gripper is aligned with the fitment, and mounts the tap onto the fitment.

With reference now to FIG. 10F, upon completion of filling and flushing operations, the second drive 122 is displaced upwardly and the filler 20 is disengaged from the fitment 18. The support 108 is moved axially downstream so as to the second position 112, wherein the gripper 28 is above and aligned with the fitment 18. The first drive 68 moves the gripper 28 downwardly so as to mount the tap 16 onto the fitment 18. In instances where the fitment assembly 72 as described above is used, the gripper 28 pushes the tap edge 84 of the tap 16 past the second stop 92 of the fitment 18, as shown in FIG. 9. Thus the tap 16 is secured to the fitment 18.

Specifically, the during tap 16 removal operations, the tap edge 84 easily overcomes the first stop 90. During tap mounting operations, the tap edge 84 easily overcomes the first stop 90, but more force is required to push the tap edge 84 past the second stop 92. The force required to push the tap edge 84 past the first stop 90 and remove the tap 16 from the fitment 18 is considerably less than the force required to remove the tap edge 84 past the second stop 92. Thus, in the transport position 74, the tap 16 is mounted so as to remain on the fitment 18 during shipping and handling, whereas in the fixed position 76, the tap 16 is mounted so as to enable the pouch for commercial use.

Figure 10G:
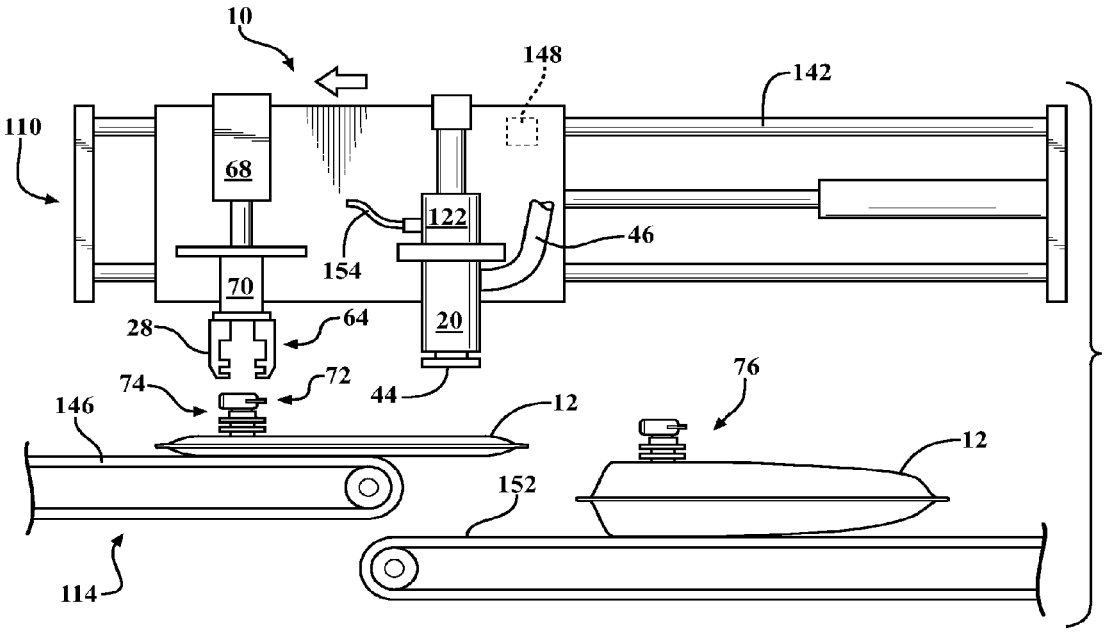
FIG. 10G, is a perspective view of the second preferred embodiment of the machine showing the support moved back to the first position, wherein the gripper is open and aligned with an unfilled pouch having a tap mounted on the fitment.
Figure 11:
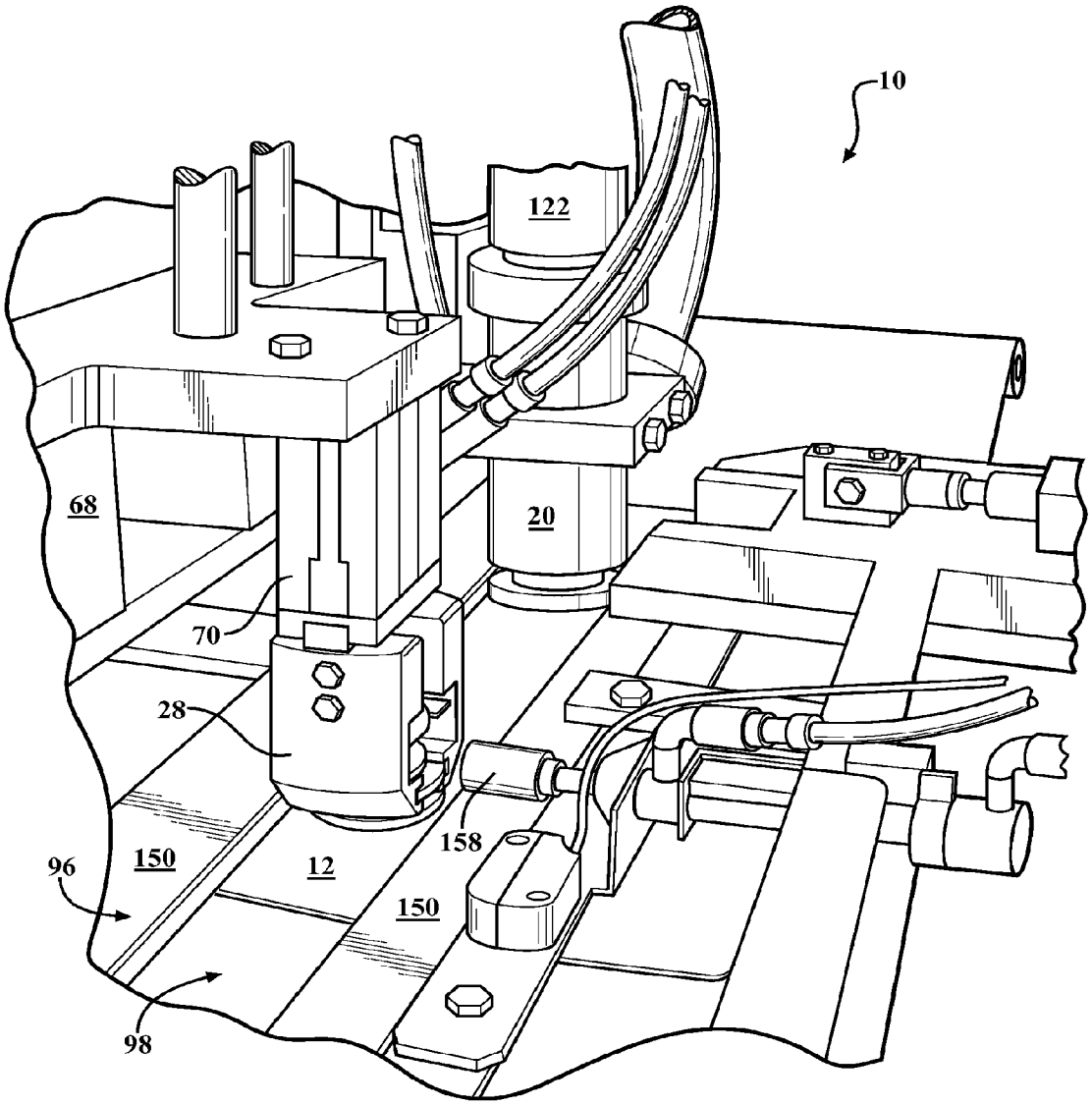
FIG. 11 is a perspective view of the second preferred embodiment of the machine.
Figure 12:
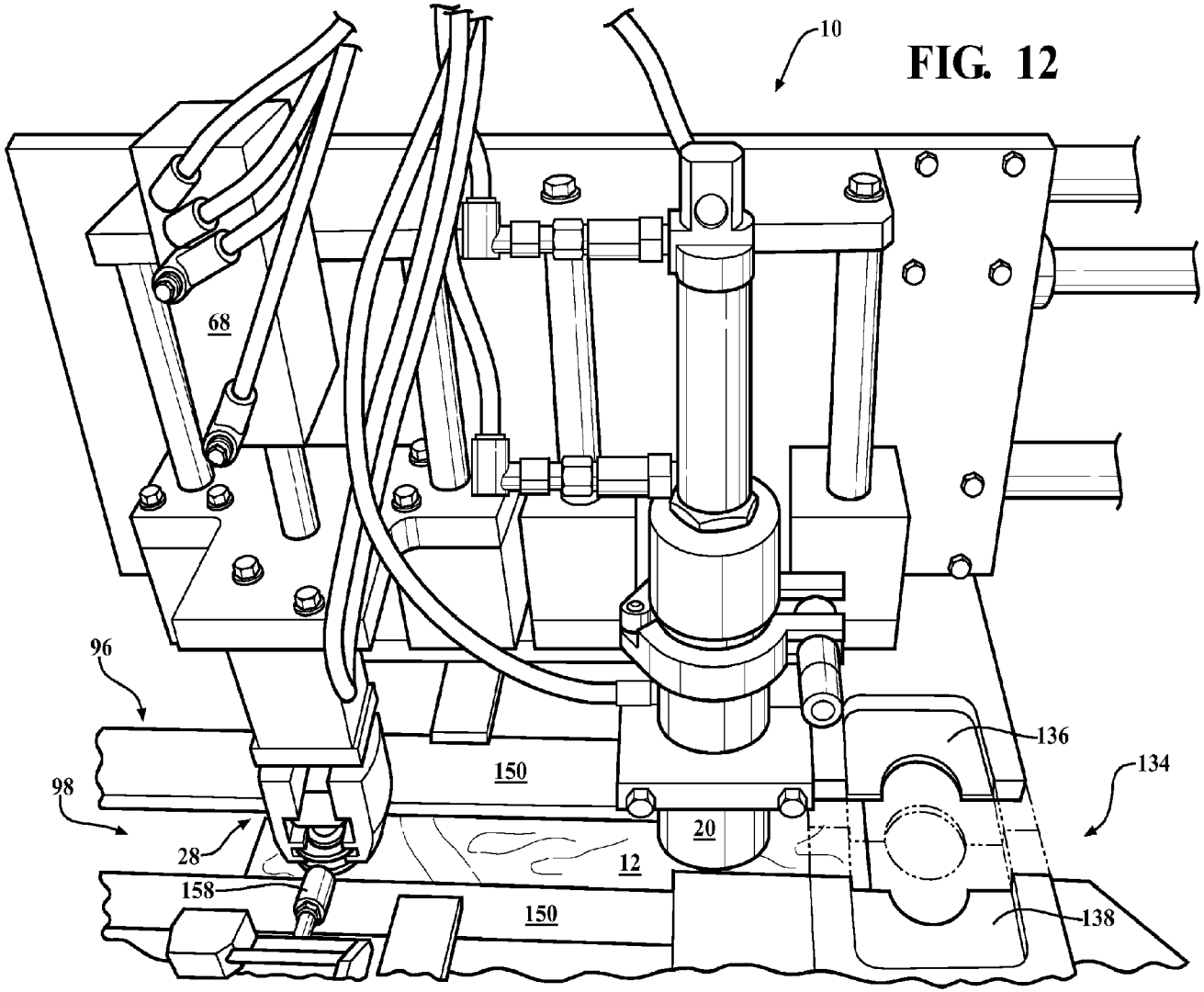
FIG. 12 is a perspective side view of the second preferred embodiment of the machine.

With reference now to FIG. 10G, the first motor 70 actuates the gripper 28 so as to move the movable side walls 32 to the open position 64. The first drive 68 moves the gripper 28 upwardly until the gripper 28 is clear of the tap 16. The support 108 is then moved upstream to the first position 110, wherein the gripper 28 is ready to engage the next unfilled flexible pouch 12 upstream the filled flexible pouch 12. The filled flexible pouch 12 may then be transported along the second conveyor 152 for packaging and shipment.

This invention has been described in an illustrative manner. Obviously many modifications and variations of the present invention are possible in light of the above teachings and may be practiced otherwise than as specifically described. For instance, the machine 10 may further include controller operable to actuate the first and second drives 68, 122, support motor 118, and clamp motor 140 in a predetermined sequence so as to automatically feed pouches to the machine 10, and fill the pouches.

The invention claimed is:

1. A machine for filling flexible pouches having a tap mounted onto a fitment, the tap having a catch and the fitment having a base, the machine operable to fill the flexible pouches with a beverage, the machine comprising:

a gripper having a lower lip configured to retain the catch of the tap, the gripper operable to remove the tap from and then mount the tap onto the fitment, the gripper movable between an engaging position and a retaining position, in the engaging position the lower lip of gripper is positioned so as to engage the tap so as to pull the tap upwardly, in the retaining position the gripper retains the tap and is displaced from the fitment, the gripper having a housing adapted to fit the tap, the housing including a pair of movable side walls, the pair of side walls movable linearly with respect to each other so as to close onto and release the tap;

a filler having a first line in fluid communication with the beverage and an opening configured to deliver the beverage, the filler movable between the fill position and a ready position, in the fill position the filler is positioned so as to engage the fitment, in the ready position the gripper is displaced from the fitment; and a support, the gripper and filler mounted on the support, the support movable between a first position and a second position, wherein in the first position, the gripper is positioned in the engaging position while the filler is positioned in the ready position and in the second position the filler is positioned in the fill position while the gripper is positioned in the retaining position.

2. The machine as set forth in claim 1, wherein the gripper includes a an upper lip disposed on each of the pair of movable side walls, the upper lip spaced apart from a respective lower lip so as to define a channel disposed above the lower lip, the channel adapted to receive an opposing portion of the catch of the fitment, the pair of side walls movable between an open position and a closed position wherein in the open position each of the pair of side walls are displaced from each other so as to receive the tap, and wherein in the closed position each of the pair of side walls are displaced towards each other so as to engage the catch.

3. The machine as set forth in claim 2, wherein each of the pair of side walls include a chamber adapted to accommodate the tap when the pair of side walls are in the closed position.

4. The machine as set forth in claim 2, further including a first motor operable to move the pair of side walls between the open and closed positions.

5. The machine as set forth in claim 2, further including a first drive operable to move the gripper to and from the closed position.

6. The machine as set forth in claim 1, further including a keep having a slot configured to receive a portion of the fitment, the keep operable to retain the fitment in a fixed position for tap removal, tap mounting and pouch filling operations.

7. The machine as set forth in claim 1, wherein the support pivots between the first position and the second position.

8. The machine as set forth in claim 7, further including a shield having a shield surface facing the opening of the filler when the support is in the first position.

9. The machine as set forth in claim 8, wherein the shield is angled so as to direct drippings from the filler away from the flexible pouch.

10. The machine as set forth in claim 9, wherein the support includes a stand, a pair of arms pivotably mounted to the stand, the gripper mounted to one of the pair of arms, and the filler mounted to the other of the pair of arms.

11. The machine as set forth in claim 9, wherein the stand is generally upright and each of the pair of arms extends radially from the stand.

12. The machine as set forth in claim 7, further including a support motor operable to move the support between the first and second positions.

13. The machine as set forth in claim 7, wherein the support moves linearly between the first position and the second position.

14. The machine as set forth in claim 13, further including a clamp, the clamp movable between a clamped position and an unclamped position, wherein in the unclamped position the clamp is configured to receive the fitment, and in the clamped position the clamped is configured to retain the fitment.

15. The machine as set forth in claim 14, wherein the clamp includes a first clamp member and a second clamp member, each having a clamp edge configured to engage the fitment, the first and second clamp member movable between the unclamped and clamped positions.

16. The machine as set forth in claim 15, further including a clamp motor operable to drive the first and second clamp members between the clamped and unclamped positions.

17. The machine as set forth in claim 13, wherein in the first position the filler is positioned to fill the flexible pouch while the gripper retains the tap, and in the second position the gripper is positioned to remove the tap from and mount the tap onto the fitment.

18. The machine as set forth in claim 13, further including a rail extending axially along a generally horizontal plane, the support is mounted to the rail.

19. The machine as set forth in claim 14, further including a first conveyor and a second conveyor, the first conveyor having a first upper surface, the first conveyor operable to feed flexible pouches to the gripper, the second conveyor having a second upper surface, the second upper surface of the second conveyor disposed below the first upper surface of the first conveyor.

20. The machine as set forth in claim 14, wherein the second conveyor is disposed downstream the first conveyor, and wherein the clamp is disposed above the second conveyor.

21. The machine as set forth in claim 13, further including a sensor operable to detect the presence of the tap, mounted to the machine so as to detect when the fitment is in alignment with the gripper.

* * * * *